US007640640B1

(12) United States Patent
Watkins

(10) Patent No.: US 7,640,640 B1
(45) Date of Patent: Jan. 5, 2010

(54) SHOELACE CONTAINMENT DEVICE

(76) Inventor: Sean Michael Watkins, 3500 N. University Blvd., Apt. 407, Jacksonville, FL (US) 32277

( * ) Notice: Subject to any disclaimer, the term of this patent is extended or adjusted under 35 U.S.C. 154(b) by 0 days.

(21) Appl. No.: 11/810,147

(22) Filed: Jun. 5, 2007

(51) Int. Cl.
*A43C 7/02* (2006.01)

(52) U.S. Cl. ..... 24/712.3

(58) Field of Classification Search ..... 24/712.1–712.9; 36/136, 50.1
See application file for complete search history.

(56) References Cited

U.S. PATENT DOCUMENTS 4,426,756 A 1/1984 Herdman
4,805,270 A 2/1989 Kimbrough
4,823,426 A * 4/1989 Bragga ..... 15/210.1
5,170,573 A 12/1992 Clinch
5,313,719 A * 5/1994 Koethe ..... 36/72 R
5,333,398 A 8/1994 Seo
5,459,947 A 10/1995 Lasher
5,566,477 A 10/1996 Mathis et al.
5,649,342 A 7/1997 D'Andrade et al.
5,671,517 A 9/1997 Gourley
6,546,649 B1 * 4/2003 Tobias ..... 36/112
6,588,078 B2 * 7/2003 Writt et al. ..... 24/712.2
6,601,323 B2 8/2003 Tsujino et al.
6,606,768 B2 * 8/2003 Henry et al. ..... 24/306
6,988,298 B2 * 1/2006 Ternasky et al. ..... 24/712.3
2002/0083620 A1 7/2002 Tsujino et al.
2004/0244162 A1 12/2004 Schneider

* cited by examiner

*Primary Examiner*—James R Brittain
(74) *Attorney, Agent, or Firm*—Harpman & Harpman

(57) ABSTRACT

A shoelace containment device for securing shoelaces after tying on a sports shoe. A flexible body member defines a lace retainment pocket with a closure flap thereover. Multiple shoe engagement straps adjustably secure the retainment pocket over the lace portion of a sports shoe.

2 Claims, 4 Drawing Sheets

SHOELACE CONTAINMENT DEVICE

BACKGROUND OF THE INVENTION

1. Technical Field

This invention relates to shoelace securing devices that are used to collect and secure the long loops and laces formed by tying shoelaces together on a laced oriented sports shoe.

2. Description of Prior Art

A number of prior art shoelace conveying and securing devices have been developed to cover or secure long shoelaces associated with sports shoes after tying or the like, see for example U.S. Pat. Nos. 5,566,477, 4,426,756, 4,805,270, 5,170,573, 5,333,398, 5,649,342, 5,671,517, 6,601,323, 5,459,947, U.S. Patent Publications 2002/0083620 A1, 2004/0244162 A1 and Japanese Patent JP2005040524.

SUMMARY OF THE INVENTION

A shoelace retainment and containment device that provides for an adjustable self-securing enclosure to be positioned over the lace portion of a sports shoe or the like. A lace receiving pocket and overlying closure flap provides for the insertion and retainment of lace loops of a tied shoelace with a knot portion secured by the closure flap thereover.

DETAILED DESCRIPTION OF THE INVENTION

Figure 2:
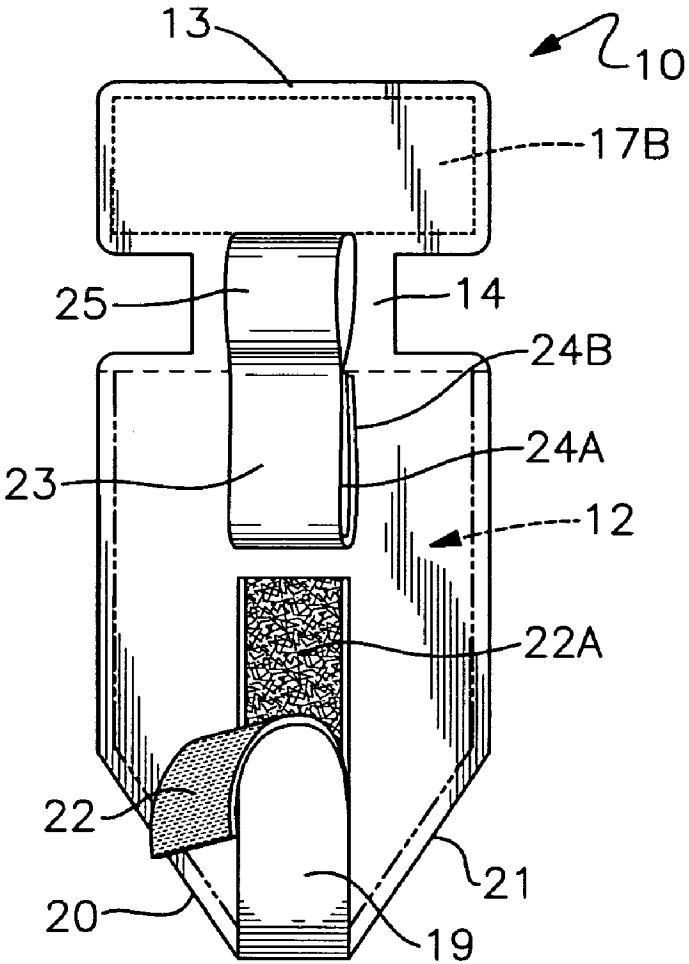
FIG. 2 is a rear elevational view thereof.
Figure 1:
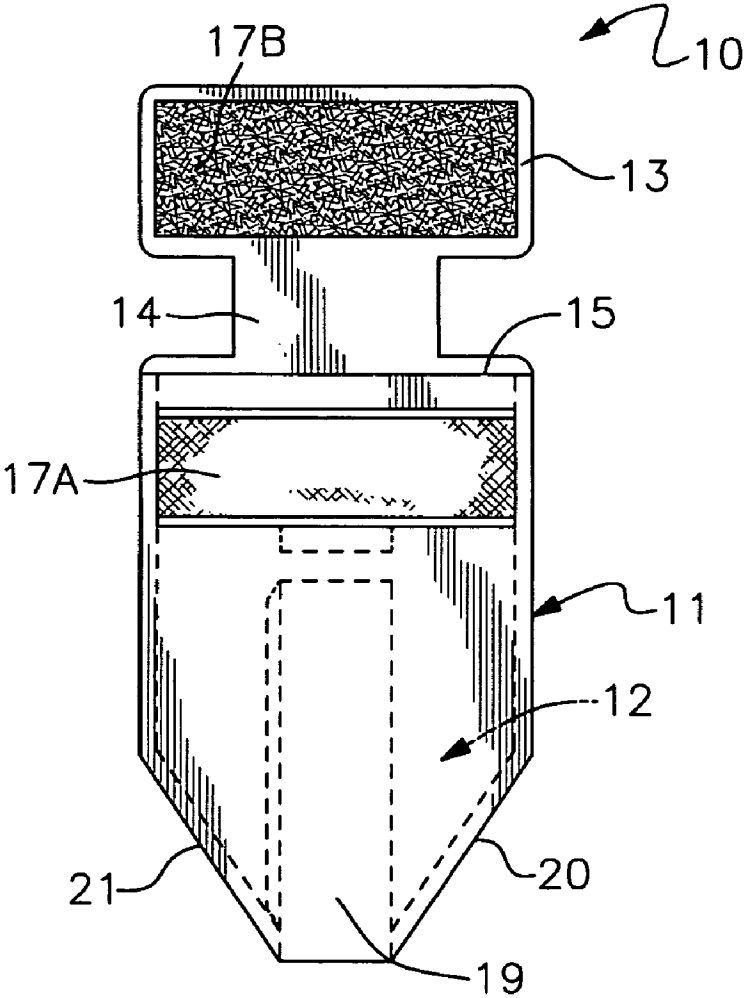
FIG. 1 is a front elevational view of the shoelace containment device.

Referring now to FIGS. 1 and 2 of the drawings, a shoelace containment device 10 of the invention can be seen having a main body member 11 in which is defined a lace retaining pocket 12 as illustrated in broken lines. A closure flap 13 extends from the main body member 11 with an interconnecting hinge element 14. A pocket access lip 15 is defined by the elongated edge open end of the pocket 12 and is used to selectively access by opening the pocket 12 as will be described in greater detail hereinafter.

A first hook and loop fastener element 17A is secured transversely across the front surface 16 upper portion of the body member 11 in spaced relation to the pocket lip 15 for corresponding registration with a second hook and loop element 17B secured to the inner surface 18 of the closure flap 13.

Referring now to FIG. 2 of the drawings a first attachment strap 19 extends integrally from the main body member 11 at the terminus of oppositely disposed angular perimeter edges 20 and 21. The attachment strap 19 has a hook and loop fastener element 22 thereon aligned for co-registration with a corresponding hook and loop fastener element 22A secured to the outer back surface BS of the main body member 11.

A second attachment strap 23 extends from the outer back surface BS of the main body member 11 in longitudinal alignment with said hook and loop fastener element 22B as hereinbefore described. The second attachment strap 23 also has a hook and loop fastening element thereon at 24A for selective registration with the correspondingly aligned hook and loop fastening element 24B on the back surface BS of the main body member 11 in spaced vertical relation to the hinge element 14. The free end of the second attachment strap 23 defines an integral engagement and adjustment loop 25 thereon in use when securing as will be described in detail hereinafter.

The hook and loop fastening elements 22A and 22B and 24A and 24B are of a commercial configuration known under the trademark as Velcro® which will be evident and obvious and well known to those skilled in the art.

Figure 5:
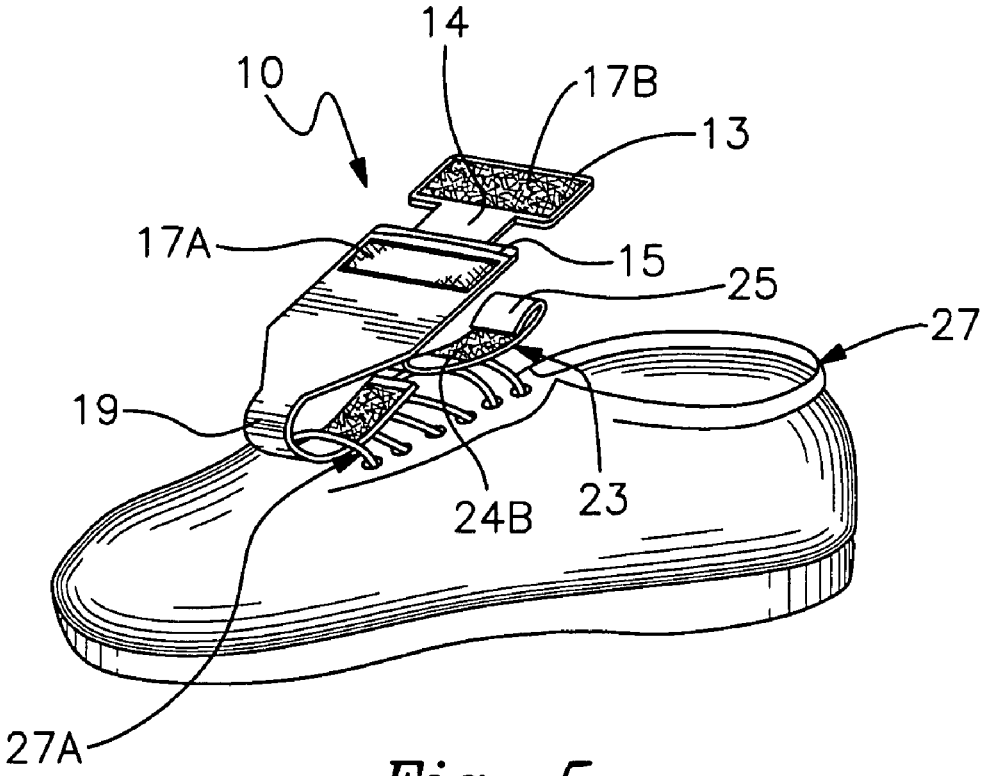
FIG. 5 is a graphic perspective view of the invention positioned on a sports shoe.
Figure 6:
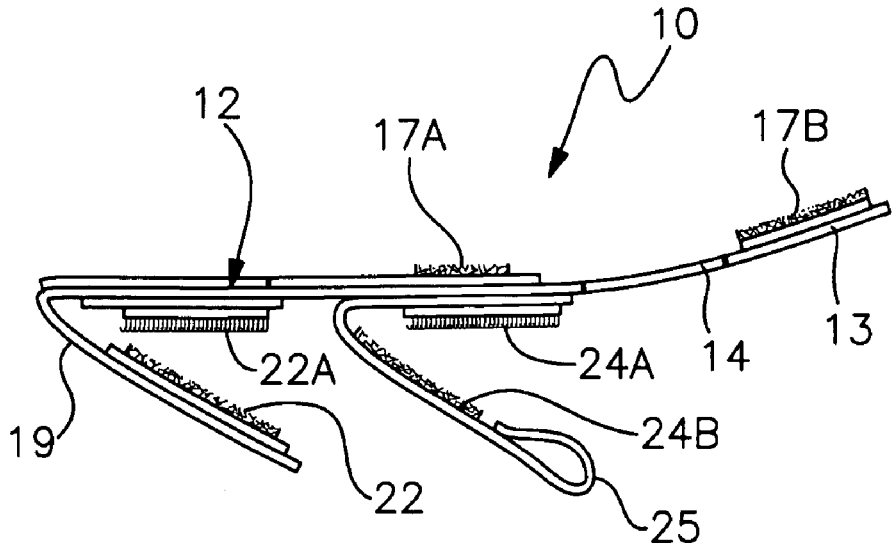
FIG. 6 is a graphic side elevational view of the invention in open extended position prior to attachment and insertion of shoelaces.

Referring now to FIG. 5 of the drawings, the shoelace containment device 10 of the invention is shown as being adjustably secured over the lace portion 26 of a sports shoe 27. The matter in which the attachment is incurred is defined by a first attachment strap 19 which is slipped under a corresponding lower cross lace 27A of the shoelace portion 26 and secured to the back surface BS in the appropriate hook and loop material 22B on the main body member 11, as noted. The second attachment strap 23 is correspondingly slipped under the appropriate cross lace so positioned and defined at 27B and adjusted for registration securement by its loop 25 by interengagement of the hereinbefore described hook and loop fastener elements 24A and 24B.

Figure 4:
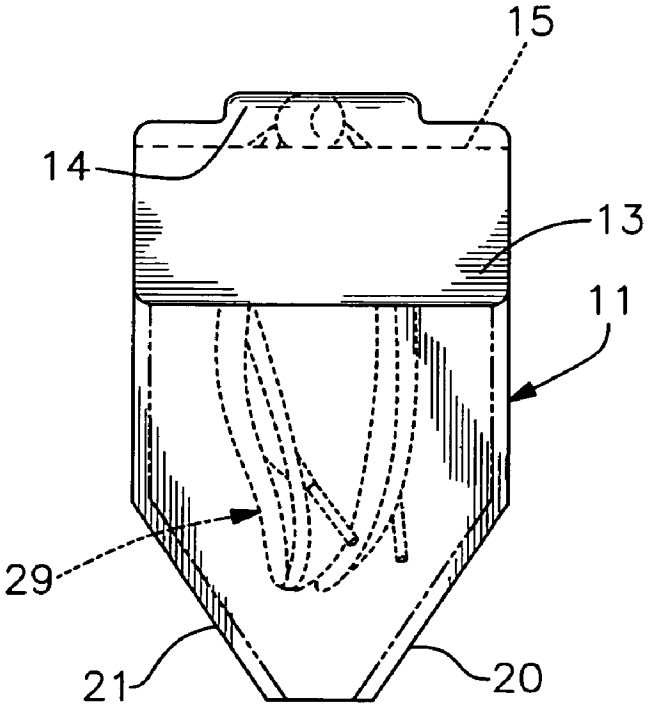
FIG. 4 is a front elevational view of the shoelace containment device with the shoelaces inserted and in closed position.
Figure 3:
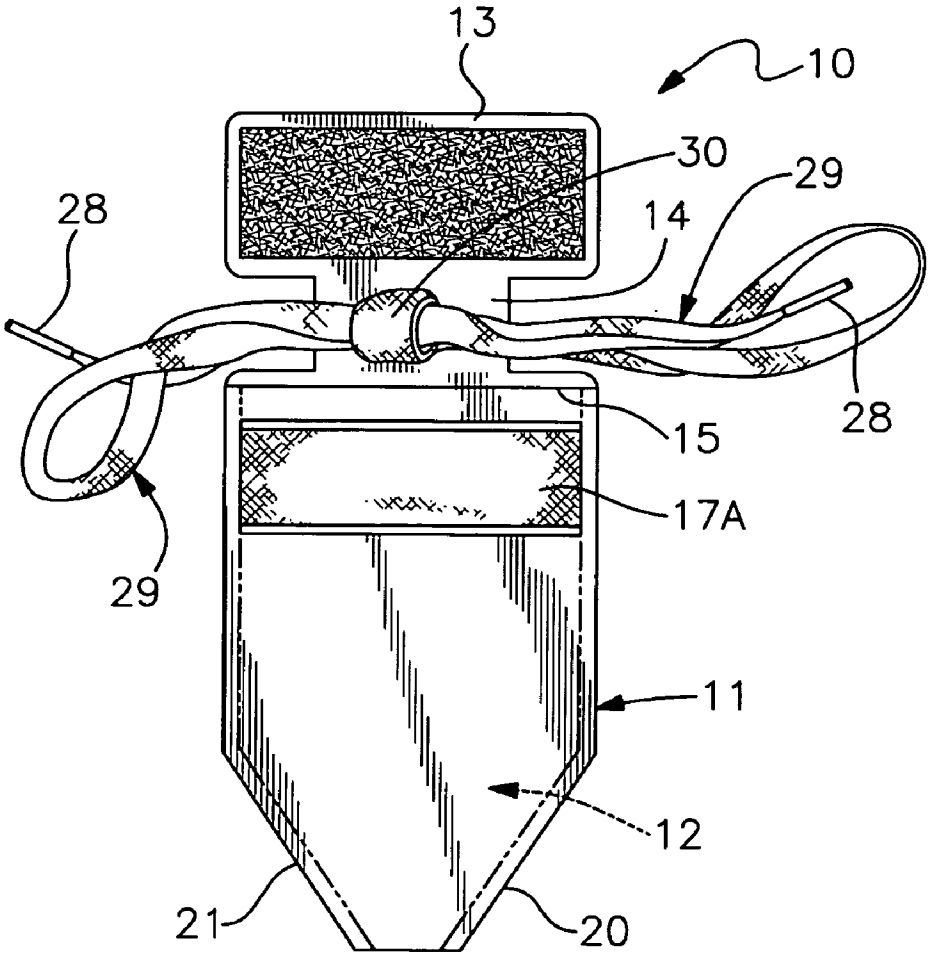
FIG. 3 is a front elevational view of the shoelace device in open position with the shoelace positioned thereon.

Referring now to FIGS. 3 and 4 of the drawings, shoelace free ends 28 are brought up and cross tied in a typical well known manner forming a bow over the hinge portion 14 forming respective bow loops 29 and a central knot 30. It will be evident that the bow loops 29 are then stuffed into the open end 16 of the pocket 12 which is open by engagement and applied force to the lip 15.

The closure flap 13 is then folded over the exposed knot 30 via its flexible hinge portion 14 and selectively secured to the front of the main body member by the interlocking and registering hook and loop fastening elements 17A and 17B as best seen in FIG. 4 of the drawings with the bow loops 29 within the pocket 12 shown in dotted lines in a safe and secure manner.

Figure 7:
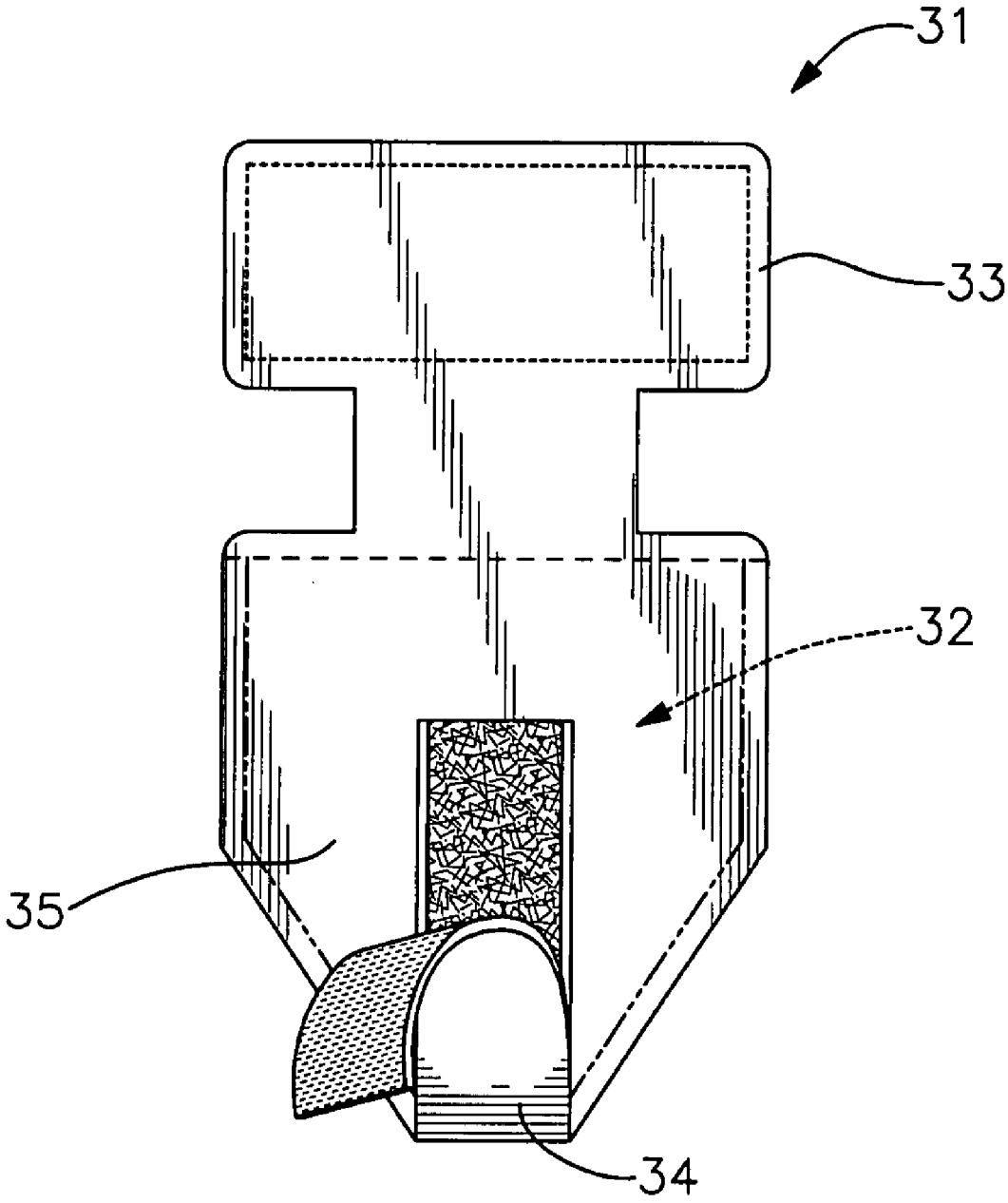
FIG. 7 is a rear elevational view of an alternate child form of reduced size and attachment fixture.

Referring now to FIG. 7 of the drawings, an alternate form of the invention can be seen wherein a child's shoelace containment device 31 can be seen having a pocket 32, closure flap 33 and is of a reduced longitudinal dimension having only one lace attachment strap 34 on its back side 35 due to its reduced dimension.

It will be noted that the various elements and construction of the shoelace containment device 10 are preferably fabricated from reinforced synthetic fabric material sewn together along perimeter edges to define the pocket 12 and appropriate attachment mechanisms are provided for securing the representative hook and loop fastener elements through the prescribed surface areas for their appropriate interengagement in securing the device to the shoelace portion 25 of the shoe 27 and correspondingly for closing of the pocket 12 by the overlying flap 13 as previously described.

It will be evident to those skilled in the art that various changes and modifications may be made to the invention without departing from the spirit of the invention.

Therefore I claim:

1. The shoelace retainment and containment device for shoes comprising, a tied lace receiving pocket having a hinge closure flap extending therefrom, a hinge portion of said closure flap of a reduced transverse dimension, fabric fasteners on said respective closure flap and said pocket selectively secured to one another, attachment straps extending from said pocket selectively secured to said pocket in oppositely disposed relation to said closure flap for engagement under said shoelaces on said shoe, said attached straps in adjacent longitudinally aligned relation to one another and said hinge portion of said closure flap, an adjustment loop tab on one of said attachment straps overlying said hinge portion, said hinge portion selectively retaining a portion of said tied shoelace outside said pocket, and pocket access lip on said pocket extending bi-laterally beyond said hinge portion.

2. The shoelace containment device set forth in claim 1 wherein said hinge closure flap is in longitudinal spaced relation to said pocket and is of an equal transverse dimension thereto.

* * * * *